United States Patent [19]

Bachmann

[11] Patent Number: 4,613,922

[45] Date of Patent: Sep. 23, 1986

[54] DOUBLE-GROUNDED WALL TANK, AND METHOD OF ITS MANUFACTURE

[75] Inventor: Werner Bachmann, Obfelden, Switzerland

[73] Assignees: Neo Vac Aktiengesellschaft, Oberriet; Adisa Service AG, Urdorf, both of Switzerland

[21] Appl. No.: 569,988

[22] Filed: Jan. 11, 1984

[51] Int. Cl.[4] ..... H05F 1/02

[52] U.S. Cl. ..... 361/215; 405/53

[58] Field of Search ..... 361/215, 216, 220, 212; 428/922; 174/5 R, 5 SG; 405/53; 427/236, 239, 410

[56] References Cited

FOREIGN PATENT DOCUMENTS 0014491 8/1980 European Pat. Off. .
517630 2/1972 Switzerland .
614417 11/1979 Switzerland .

*Primary Examiner*—L. T. Hix
*Assistant Examiner*—Della Rutledge
*Attorney, Agent, or Firm*—Frishauf, Holtz, Goodman & Woodward

[57] ABSTRACT

To permit monitoring of tightness of a tank, particularly buried tanks for highly flammable or explosive liquids such as gasoline, flammable hydrocarbon solvents, acids, alkaline solutions and the like, and prevent formation of sparks due to electric charge of an inner liner, the inner surface of the tank has an embossed aluminum foil applied thereagainst, the inner surface of which has an epoxy layer (19) applied thereto by spraying, so that the depressions opposite the corrugations or projections (17) of the foil (15) will be filled with the epoxy. After curing, the epoxy layer (19), preferably fiber-reinforced, is tested for freedom from pores and proper thickness by standard spark induction and eddy current testing methods, and then has another resin layer, preferably epoxy, applied thereto which is made electrically conductive by additives of metal, or carbonaceous granules, flakes or fibers, such as aluminum, nickel, copper brass or of graphite.

18 Claims, 1 Drawing Figure

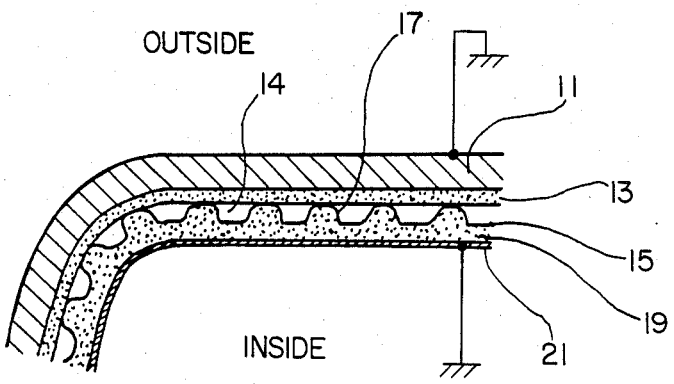
OUTSIDE
17
14
11
13
15
19
INSIDE
21

DOUBLE-GROUNDED WALL TANK, AND METHOD OF ITS MANUFACTURE

The present invention relates to storage tanks of the double-wall type, in which both walls of the storage tank are electrically conductive, and can be grounded, so accumulation of static electricity on any one of the walls of the tank, and hence possible danger of explosion due to sparking can be avoided. The invention is particularly applicable to storage tanks for gasoline or other flammable solvents in which, between the two walls of the tank, a chamber or space is provided which can be monitored for leaks and hence possible contamination of the surrounding ground by the contents of the tank or vessel.

BACKGROUND

Underground storage of flammable liquids, typically gasoline, volatile hydrocarbon solvents, petroleum derivatives of all kinds, as well as acids, alkaline solutions, and other potentially hazardous substances causes problems since the contents of the tanks, upon leakage thereof, may contaminate the surrounding soil. This problem was graphically described before the Toxic Substances Subcommittee of the Senate Environment and Public Works Committee by Mr. Jack E. Ravan, Assistant Administrator of the Environmental Protection Agency (EPA) in testimony late November 1983. It was noted that it is estimated that millions of gallons of gasoline leak into the ground each year from tanks at service stations and other storage areas, and pose a potentially serious threat to the nation's underground water supplies. It has previously been proposed to construct double-wall tanks, and evacuate the space between the inner and outer wall. The vacuum thus generated is monitored; upon leakage, for example due to corrosion, or other defects of either one of the walls, the vacuum will collapse quite fast; a monitoring instrument will indicate the absence of vacuum between the two walls of the vessel and thus provide an indication that leakage may occur; the tank can then be emptied and repaired before leakage of the ground has occurred if one of the walls has remained intact; if both should have been punctured, leakage to the surrounding ground area can be stopped rapidly.

Various ways to modify existing tanks to detect leakages have been proposed. On tanks for heating oils, it is known to provide an inner wall separated from an outer, existing wall. The inner wall of the existing tank is first lined with sheets of aluminum having a plurality of knobs, bumps, bosses or similar projections, or corrugations formed thereon. A plastic liner, or an inner plastic foil, is then applied to the aluminum sheet, forming the inner wall of the tank. The space defined between the inner and the outer wall is then partly evacuated and the vacuum monitored. This method of modifying tanks is suitable for tanks or vessels which store products having a relatively high flame point. It is suitable for bunker oil, and even for commercial "No. 2" home heating fuel. In general, any product which has a flaming point of about 55° C. or higher may be stored in tanks of this type. Liquids which are highly flammable, however, cannot be safely stored in tanks of this type. The plastic foil or liner is, for all practical purposes, an electrical insulator, and thus electrostatic charges which arise due to friction, for example, or sloshing of the liquid upon filling or withdrawal thereof cannot be rapidly dissipated or leaked to ground. Sparks may occur upon inspection of the tank, for example, or upon other handling, e.g. outside connections. Such sparks may cause explosions of explosive gases which accumulate in a tank which is empty, or which form above the liquid level of the substances within the tank and its top.

It has been proposed to modify gasoline tanks to become leakproof by introducing relatively small panels or sheet material through a manhole and to weld the sheets together to an inner wall, thus forming, practically, a second tank inside the first tank, with a space between the tanks which can be monitored for a vacuum, as described above (see, for example, Swiss Patent No. 614,417). The inner wall, being made of sheet metal, is electrically conductive, and thus there is no danger of accumulation of electrostatic charges, and hence sparking due to accumulated charges. This method of modifying existing tanks, for example of already buried tanks, while satisfactory in result is extremely expensive, requires skilled welders, and is difficult to carry out in many installations.

It has also been proposed to provide a double-wall tank having an inner wall made of glass fiber-reinforced polyester which has an electrically conductive layer made of chrome mickel fabric, or wire mesh embedded therein (see Published European Patent Application No. 00 14 491). Manufacture of such a tank by manually applying a laminate of glass fiber-reinforced polyester and a wire mesh on the soft laminate is time-consuming and hence expensive. The arrangement has a further disadvantage: It is frequenty desirable to test the integrity of the inner liner by spark inductors, and by eddy current testers.

It is particularly important in connection with polyester laminates to check the laminate for both thickness as well as porosity. If a wire mesh is located on the laminate before it has hardened or cured, it is no longer possible to make the standard tests with spark inductors and eddy current apparatus for porosity and thickness. Thus, any testing must be done by filling the tank with a liquid, which test, however, will not discover thinner spots in the inner liner, only possible leakage.

It has also been proposed—see German Published Patent Application DE-AS No. 26 20 225—to construct a vessel of cement or concrete which has a coating of polyester resin on the bottom as well as on the side walls of the tank. The polyester resin is made of a multi-layer lamination. The vertical cement walls have a first multi-layer liner applied, made of polyester. A metallic foil, for example of about 2 mm thickness, and formed with knobs, projections, bumps, bosses or corrugations, is then applied to the first multi-component layer. A second layer is then applied, on the inside of the tank, over the intermediate metal foil, the space between the layers forming the vacuum space which can be monitored to determine leakage. To provide for electrical connection and grounding of the inner, or second layer, the polyester resin thereof is made electrically conductive by adding, for example 25% of graphite powder thereto. The specific resistance of the second, or inner layer will be about 500 meg ohms. The quantity of graphite powder is so controlled that the characteristics of the second, or inner layer with respect to strength and sealing capacity, or absence of porosity is hardly affected, but some electrical conductivity is obtained. Since the path of discharge current is across the thickness of the inner layer, and thus is short, any electrical charge which might build up on the second, or inner layer can be leaked off to the embossed metal foil therebehind, and then connected to the outer, metallic tank.

Manufacture of a vessel using this arrangement is expensive and highly labor and material intensive. The polyester laminates must be applied manually, on-the-job, and painstakingly joined. The thickness of the layer, as well as the freedom from pores, cannot be checked after application since the second, or inner layer is electrically conductive. The standard tests for thickness and porosity, thus, by spark inductor and eddy current test apparatus cannot be carried out.

It has also been proposed to provide a vessel or tank made of cement or concrete with an inner wall of polyester in which the cement walls are covered with an aluminum foil so that the inner polyester can be checked for freedom from pores and to localize any possibly occurring openings by means of a spark inductor, and to check the thickness of the polyester layer or sheet by an eddy current tester (see Swiss Patent No. 517,630). The polyester layer on the aluminum foil faces the inside of the tank and, since the polyester is highly electrically insulating, it cannot leak off charges to the aluminum foil and thus accumulate electrostatic charges. Such a tank is not suitable for highly flammable liquids, which may release explosive gases and which may cause explosions upon occurrence of a spark. Tanks of this type are only suitable for substances which have a very high flame point and cannot be triggered to combustion or explosion by a spark.

THE INVENTION

It is an object to provide a double-wall tank, and a method of making it, particularly to retrofit an already existing single-wall tank with double walls to permit monitoring of freedom of leakage by the known vacuum-monitoring process, which is simple, in which the freedom from porosity of the inner wall can be tested and supervised by standard monitoring and testing apparatus, and in which the thickness of the inner wall, likewise, can be readily checked.

Briefly, an outer metallic tank, which may be an existing steel tank buried in the ground, has a corrugated or embossed or otherwise similarly formed metal liner applied thereto, connected to the inner surface of the outer wall for example by adhesive strips, or by an adhesive coating. The inner surface of the metal liner is then sprayed with a fiber-reinforced, preferably glass fiber-reinforced epoxy resin, the epoxy resin filling the depressions formed by the embossed projections which extend towards the outer wall, and forming a smooth inner surface. The glass fiber-reinforced epoxy resin is strong, and electrically insulating. After application of the glass fiber-reinforced epoxy resin, the thus semi-finished tank is checked by readily available spark inductor and eddy current testers for freedom from pores, and uniformity of thickness of the epoxy resin layer. This can readily be done since the material is insulating, but backed up by conductive material, namely the embossed foil. The projections, corrugations, knobs, bosses, bumps and the like of the embossed foil define a space which can be evacuated, the vacuum then being monitored to detect possible leakage. In accordance with a further feature of the invention, the layer of epoxy, after checking for proper thickness and freedom from pores, has an additional layer of epoxy resin applied thereto, by spray application, which may also have reinforcing fibers added thereto, for example glass fibers. The second or inner or final epoxy layer is made to be electrically conductive, for example by adding powder, granules, fibers or flakes of nickel, aluminum, copper, brass, carbon, silvered copper powder, all with or without graphite, or graphite in a suitable mixture and proportion such that the strength and integrity of the inner layer is not affected, but sufficient electrical conductivity is obtained to permit connection of the inner, now conductive layer to ground, or the outer shell, and thus prevent build-up of electrostatic charges on the layer facing the contents of the vessel or tank.

A suitable spacer foil is embossed aluminum. Embossed aluminum foils can be easily worked and applied, which is particularly important upon retrofitting or re-building of existing, installed, buried tanks. The method of spray application of the epoxy layers, first without electrically conductive additives and then with the additives, is fast, reliable, and safe.

If, after application of the first layer of glass fiber-reinforced epoxy, the spark tests and eddy current tests should show defects or thin regions in isolated portions of the layer, then it is easily possible to remedy such defects, seal any possible pores or leakages, or build up the sprayed-on layer to the required thickness before the second epoxy layer, which is electrically conductive, is applied. Test apparatus, thus, available and suitable for testing the thickness of insulating material can be used, the electrically conductive inner layer being applied by essentially the same spray application equipment as that being used for application of the first, non-conductive layer. Expensive, careful and tight fitting and bonding of sheets thus is avoided, and the tanks can be rapidly retrofitted and converted to double-wall tanks with an intervening space suitable for vacuum-monitoring of leakage.

In accordance with a preferred feature of the invention, the inner surface of the outer wall of the tank has a layer or film or coating of plastic material, typically epoxy, applied before the embossed metal foil is inserted. This is an additional protection and prevents occurrence of leakages even if the outer tank should develop rust spots at certain locations. The inner epoxy seal, thus, of the outer tank substantially extends the lifetime of the overall installation. Furthermore, no drop or loss of vacuum will occur even if the outer tank should develop pores or pin-type holes, for example due to corrosion, and resulting in false alarms.

DRAWING

The single FIGURE is a fragmentary cross section through the wall of a tank which, for example, may be buried in the ground.

DETAILED DESCRIPTION

The outer wall 11 of a tank which, for example, is buried, is made of steel. It is intended to retrofit an existing tank having only the outer wall 11 by providing a leakage detection vacuum space, and a new inner wall which is so constructed that build-up of electrostatic charges are avoided.

After emptying and cleaning of the tank, an inner protective layer 13 is applied, for example by spraying. Layer 13 is an epoxy layer, reinforced with glass fibers, with a thickness of from about 0.5 to 4 mm. Layer 13 is not strictly necessary, but desirable.

A spacer foil 15 is then applied, the spacer foil 15, for example, being formed of embossed aluminum having a sheet thickness of, for example, about 0.2 mm. The embossing of the aluminum foil is shown to form projections, knobs, bumps, or corrugations 17. The foil can be applied to the inner coating 13, or the inner wall of the tank 11, as desired, by a suitable adhesive, for example with double-face adhesive tapes or strips.

In accordance with the invention, an epoxy layer 19, reinforced with glass fibers or other suitable reinforcement fibers is then applied to the inner side of the foil 15 by spraying. The minimum thickness of the layer 15 should be in the order of about 4 mm. The space between the outer surface of the foil 15 and the inner surface of the tank 11—or of the layer 13, if used—defines a chamber or space 14 which can be evacuated, the vacuum then being monitored as well known.

To prevent build-up of electrostatic charges, electrically conductive material is applied over the layer 19, which is spray-coated on the epoxy layer 19. While epoxy, with electrically conductive additives, is suitable, other materials may also be used, such as polyurethane, having, for example, an additive of granular aluminum or aluminum flakes and graphite. Other conductive materials, such as nickel granules or flakes, aluminum fibers, graphite, carbon black, copper flakes, copper granules, copper fibers, brass flakes, brass granules, brass fibers, carbon fibers, or silvered copper powder, also are highly suitable. The selection of the particular material used will depend, primarily, on compatability with the epoxy resin, and on cost of the additive at any time.

METHOD OF RETROFITTING A BURIED STEEL TANK

The steel tank 11 first has a stub pipe and valve connected to communicate with the space immediately adjacent the interior surface of the wall 11, so that, after the space 14 has been formed, a vacuum pump can be applied to evacuate the space 14, and, subsequent to evacuation, the continuous maintenance of the vacuum can be monitored, and failure of vacuum indicated, thus indicating leakage. After connecting a suitable pneumatic communication stub—not shown—and in accordance with any suitable plumbing process, the inner surface of the steel tank is sandblasted for thorough cleaning and slight roughening of the surface. If desired, and for best and most long—life application, an inner epoxy coating 13 is applied by spraying the layer 13 on the sandblasted inner surface of the tank 11. The embossed aluminum foil 15 is then applied on the layer 13, for example by an adhesive. As soon as the embossed aluminum foil 15 is in place, fiber-reinforced epoxy layer 19 is applied by spraying. The epoxy layer 19 is then permitted to cure. After the epoxy layer 19 has cured sufficiently for integrity of the layer 19, it is tested by a spark induction tester for freedom from pores. At the same time, or shortly thereafter, the layer 19 is tested for appropriate and uniform thickness by an eddy current tester, as well known. Such eddy current testers generate eddy currents in the embossed aluminum foil 15, and the current flowing through the tester is a measure for the thickness of the layer 19, when the tester is applied to the layer 19. If the tests indicate any pores or thin spots, then such pores or thin spots can be immediately repaired at that time. Pores can be sealed, and thin spots built up by spraying more fiber-reinforced epoxy resin in the affected area. After repair or reconstruction of the specific region or zone which was found defective, it should, again, be tested for integrity and proper minimum thickness.

When the entire layer 19 has been checked and found to be free from pores, thin spots or areas or the like, the further layer 21, with the electrically conductive additives, is then applied, layer 21 forming the inner layer which will be in contact with the liquid to be retained in the tank. This inner layer, then, will be electrically conductive and can be connected through a suitable ground strap, permanently, to ground, and, further, preferably to the outer steel wall 11 and to the aluminum sheet or foil 15, so that all electrically conductive components of the tank are grounded.

The respective epoxy layers 19, 21 will bond together upon application of layer 21, and layer 19 will bond to the inner surface of the embossed foil 15, the outer surface of which is adhered to the inner surface of the wall 11, or the coating 13, respectively, to which it could also be bonded after application of the coating 13 and before complete curing thereof.

Various changes and modifications may be made within the scope of the inventive concept.

The following materials have been found commercially suitable:

Layer 19:

Adapox Green 521, a two-part solventless, room-temperature curing coating, based on Pt. A: Pigmented, thixotropic liquid epoxy resins, containing chopped glass fibers.

Pt. B: An aromatic polyamine-adduct.

Layer 21:

Adapox L 226, a two-part, solvent-containing coating based on

Pt. A: A pigmented solution of high molecular weight epoxy resins, with graphite constituting the major share of the pigments.

Pt. B: A solution of an aromatic polyisocyanate. Both coatings are available from Togo-Wyandotte Corp., Troy, Mich. 48084.

I claim:

1. Double-grounded wall tank, particularly for storage of potentially explosive or highly combustible substances such as gasoline, other petroleum products, volatile hydrocarbon solvents, acids, alkaline solutions and the like, having a metal outer wall (11) which is electrically connected to ground;

an inner wall (19, 21); and a spacer foil (15) separating the outer and inner walls and defining therebetween a test chamber (14) to permit pneumatic supervision of fluid tightness of the outer and inner walls, respectively, wherein, in accordance with the invention, the inner wall comprises a composite layer including a non-porous fiber-reinforced epoxy layer sprayed on the spacer foil spray-connected on the spacer foil (15) and bonded thereto;

and an electrically conductive inner resin layer (21) spray-connected on the non-porous fiber-reinforced epoxy layer and bonded thereto, said electrically conductive inner resin layer (21) being positioned at the inside of the tank for contact with the substance to be retained therein and electrically groundable to prevent build-up of static electricity thereon.

2. Tank according to claim 1, wherein the electrically conductive inner layer (21) comprises an epoxy resin with electrically conductive additives therein.

3. Tank according to claim 1, wherein said tank is buried in the ground.

4. Tank according to claim 1, wherein said spacer foil is embossed and formed with corrugations, knobs, bumps, bosses or projections extending from one surface, and defining matched depressions on the other surface;

- the outer wall (11) has an essentially smooth inner surface, the space between the smooth inner surface of the outer wall and the corrugations or projections defining said chamber (14); and wherein the fiber-reinforced epoxy of the non-porous fiber-reinforced epoxy layer extends into the depressions.

5. Tank according to claim 4, wherein the spacer foil (15) is adhesively secured to the inner surface of the outer wall (11) by adhesion of the corrugations or projections of the foil to the inner surface of the wall.

6. Tank according to claim 1, wherein the electrically conductive inner layer (21) comprises a sprayable, curable plastic resin with an additive comprising graphite and aluminum granules or aluminum flakes.

7. Tank according to claim 1, wherein the electrically conductive additives comprise at least one of: nickel granules, nickel flakes, aluminum fibers, graphite, carbon black, copper flakes, copper granules, copper fibers, brass flakes, brass granules, brass fibers, carbon fibers, silvered copper powder, graphite and aluminum granules or aluminum flakes.

8. Tank according to claim 6, wherein the resin comprises epoxy.

9. Tank according to claim 7, wherein the resin comprises epoxy.

10. Tank according to claim 1, wherein the tank is buried in soil or the ground;

the outer wall (11) is electrically connected to ground;

and the electrically conductive inner layer (21) is connected to ground.

11. Tank according to claim 1, further including a layer of resin (13) interposed between the inside surface of the outer wall (11) and the spacer foil (15);

and wherein the spacer foil is an embossed foil formed with corrugations, knobs, bumps, or projections, said corrugations, knobs, bumps, or projections being adhered to said resin layer (13).

12. Tank according to claim 2, wherein the electrically conductive layer comprises graphite.

13. Method of forming a double wall in an existing single-wall tank having an outer wall (11) of electrically conductive material, which is grounded, particularly for storage of potentially explosive substances such as gasoline, petroleum products, volatile hydrocarbon solvents, acids, alkaline solutions, and the like, comprising the steps of applying an embossed spacer foil to the inner surface of the outer wall (11, 13), said foil defining a test chamber (14) between projections extending towards the inner surface of the outer wall and the foil;

applying a fiber-reinforced epoxy layer (19), by spraying fiber-reinforced epoxy on said foil from the inside of the tank;

permitting the thus applied spray epoxy layer to cure or harden;

testing the cured or hardened epoxy layer (19) for at least one of: freedom from pores; thickness of layer;

and, if the tests show freedom from pores and a predetermined thickness of the layer (19), applying an electrically conductive resin layer (21) by spraying, on the fiber-reinforced epoxy layer (19).

14. Method according to claim 13, including the step of repairing zones or regions of the cured fiber-reinforced epoxy layer (19) upon detection of at least one of: porosity; insufficient thickness;

re-testing said zone;

and then applying the electrically conductive resin layer.

15. Method according to claim 14, wherein the step of applying the electrically conductive resin layer comprises spraying an epoxy layer with electrically conductive additives contained therein on the fiber-reinforced epoxy layer (19).

16. Method according to claim 15, wherein said additives comprise at least one of the materials of the group consisting of: aluminum granules and graphite; aluminum flakes and graphite; nickel granules, nickel flakes, aluminum fibers, graphite, carbon black, copper flakes, copper granules, copper fibers, brass flakes, brass granules, brass fibers, carbon fibers, silvered copper powder.

17. Method according to claim 13, further including the step of applying a layer of resin (13) on the inner surface of the outer wall (11) prior to application of the embossed spacer foil (15).

18. Method according to claim 14, wherein the step of applying the electrically conductive resin layer comprises graphite.

* * * * *